US006112387A

United States Patent [19]

Hinchliffe et al.

[11] Patent Number: 6,112,387

[45] Date of Patent: Sep. 5, 2000

[54] YARN TREATMENT JET

[75] Inventors: Malcolm Geoffrey Hinchliffe, Macclesfield; Reginald Leah, Prestbury, both of United Kingdom

[73] Assignee: Fibreguide Limited, Macclesfield, United Kingdom

[21] Appl. No.: 09/346,842

[22] Filed: Jul. 2, 1999

[30] Foreign Application Priority Data

Jul. 4, 1998 [GB] United Kingdom ..... 9814476

[51] Int. Cl.[7] ..... D02J 1/08

[52] U.S. Cl. ..... 28/274; 28/275; 57/908

[58] Field of Search ..... 28/271, 272, 273, 28/274, 275, 276; 57/908, 350, 333, 289

[56] References Cited

U.S. PATENT DOCUMENTS

| | | | |
|---|---|---|---|
| 4,069,565 | 1/1978 | Negishi et al. | 28/275 |
| 4,240,188 | 12/1980 | Zoina | 28/274 |
| 4,251,904 | 2/1981 | Sano et al. | 28/274 |
| 4,365,394 | 12/1982 | Matsumoto et al. | 28/274 |
| 4,417,375 | 11/1983 | Sano et al. | 28/275 |
| 4,422,224 | 12/1983 | Gusack et al. | 28/272 |
| 4,497,099 | 2/1985 | Scott | 28/273 |
| 4,644,620 | 2/1987 | Maeda | 28/274 |
| 4,934,133 | 6/1990 | Stalder et al. | 28/274 |
| 5,010,631 | 4/1991 | Ritter | 28/274 |
| 5,146,660 | 9/1992 | Ritter | 28/274 |
| 5,970,593 | 10/1999 | Sear | 28/274 |

*Primary Examiner*—Amy B. Vanatta
*Attorney, Agent, or Firm*—Schwegman, Lundberg, Woessner & Kluth, P.A.

[57] ABSTRACT

A yarn treatment jet has a yarn passage extending through the body of the jet and a fluid inlet intersecting the yarn passage transversely. In cross-section the yarn passage has a main part and a substantially parallel sided yarn controlling part which is of lesser width than the main part. The width of the fluid inlet is greater than that of the controlling part but less than that of the main part. The yarn is guided to run in the yarn controlling part which the fluid inlet intersects and the fluid is directed past the running yarn in the direction of the main part. The yarn guides are movable towards and away from the inlet and outlet ends of the yarn passage. A curved threading slot connects the controlling part with the outside of the jet.

17 Claims, 1 Drawing Sheet

YARN TREATMENT JET

FIELD OF THE INVENTION

This invention relates to yarn treatment jets, and in particular to intermingling jets for intermingling the filaments of a multifilament textile yarn.

BACKGROUND OF THE INVENTION

Many configurations of intermingling jets are known. Generally such jets have a body through which a yarn passage extends, with one or more fluid inlets communicating with the yarn passage in a transverse direction so as to direct a jet or jets of the fluid laterally of the yarn as it passes through the yarn passage. Generally also, for intermingling purposes, the cross section of the yarn passage is symmetrical about a longitudinal axis and the axis or axes of the fluid inlet(s) intersect(s) the axis of the yarn passage so that there is no or little twisting effect on the yarn. The transverse flow of fluid causes the filaments of the running yarn to whirl about in the yarn passage and become intermingled. Such treatment jets intermingle multifilament yarns with differing degrees of success. One of the major problems of such jets is that the filaments whirl about in an uncontrolled manner so that the degree of intermingling varies along the length of the yarn, creating dye shade and feel variations in a fabric knitted or woven from the resulting yarn.

OBJECT OF THE INVENTION

It is an object of the present invention to provide a yarn treatment jet for intermingling the filaments of a multifilament yarn in which the whirling of the filaments is more controlled, and in consequence the degree of intermingling along the length of the yarn is more uniform and more consistent from jet to jet, than has been achieved with known jets.

SUMMARY OF THE INVENTION

The invention provides a yarn treatment jet comprising a body having a yarn passage extending longitudinally therethrough and an inlet for a fluid intersecting the yarn passage transversely thereof, wherein the yarn passage has in cross section a main part and a yarn controlling part of lesser width than the main part.

The fluid inlet may intersect the yarn controlling part and direct the fluid in the direction of the main part. The fluid inlet may have a width which is greater than that of the yarn controlling part, and which is equal to but preferably less than that of the main part. The yarn treatment jet may have yarn guides adjacent the inlet and outlet ends of the yarn passage, which yarn guides are disposed to guide a running yarn through the yarn controlling part of the yarn passage. The yarn guides may be positionally adjustable towards and away from the jet body.

The yarn treatment jet may have a threading slot extending longitudinally thereof, which threading slot communicates with the outside of the body and the yarn passage. The threading slot may communicate with the yarn passage in the yarn controlling part. The threading slot may be curved between the outside of the body and the yarn passage. The outer end of the threading slot may be enlarged relative to the remainder of the threading slot. The main part of the yarn passage may be circular in cross-section, or may be triangular in cross-section. The controlling part of the yarn passage may have sides that are substantially parallel.

BRIEF DESCRIPTION OF THE INVENTION

The invention will now be described with reference to the accompanying drawing in which.

DESCRIPTION OF THE PREFERRED EMBODIMENTS

Figure 1:
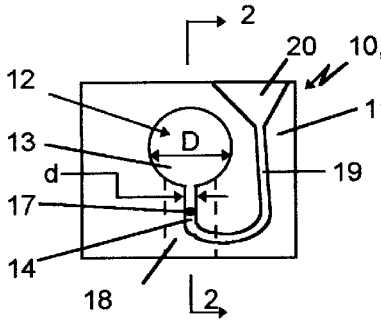
FIG. 1 is an end elevation of a yarn treatment jet.
Figure 4:
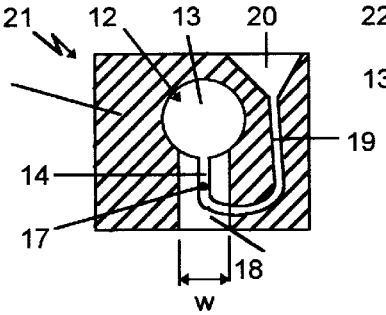
FIG. 4 is a section on line 4—4 of FIG. 2 or FIG. 3.
Figure 2:
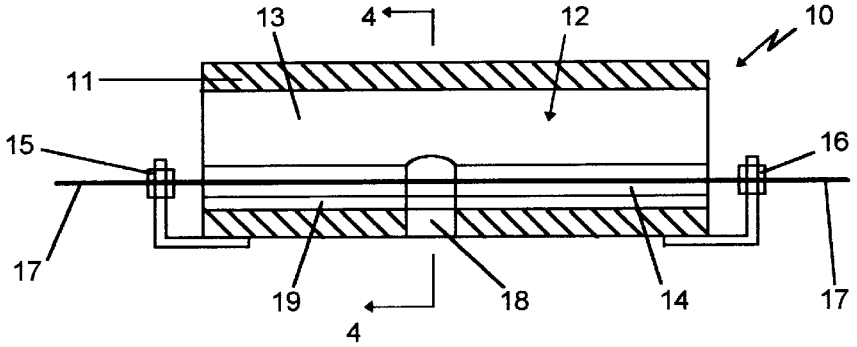
FIG. 2 is a longitudinal section on line 2—2 of the jet of FIG. 1.

Referring now to FIGS. 1, 2 and 4, there is shown a yarn treatment jet 10 having a body 11 and a yarn passage 12 extending longitudinally therethrough. The yarn passage 12 has in cross section, as shown in FIGS. 1 and 4, a main part 13 and a yarn controlling part 14. A yarn inlet guide 15 and a yarn outlet guide 16 adjacent the inlet and outlet ends respectively of the yarn passage 12 are disposed to guide a running yarn 17 through the yarn controlling part 14. A fluid inlet 18 is formed in the body 11 so as to intersect the yarn passage 12, in this case perpendicularly. More particularly, the fluid inlet 18 intersects the yarn controlling part 14 and directs the fluid through the yarn controlling part 14, past the running yarn 17 and towards the main part 13. Preferably the fluid is air. A yarn threading slot 19 extends longitudinally of the body 11 and communicates with the outside of the body 11 and the yarn passage 12, more particularly with the bottom of the yarn controlling part 14. For ease of threading, the outer end 20 of the threading slot 19 is enlarged relative to the remainder of the threading slot 19, which is curved between the outer end 20 and the yarn controlling part 14 so as to lessen any tendency for the yarn 17 to come out of the passage 12 under the influence of the fluid jet.

Figure 5:
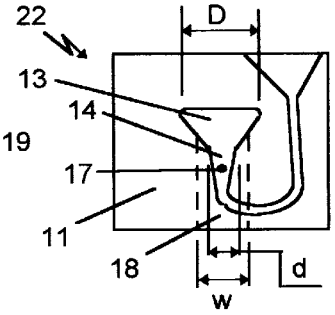
FIG. 5 is a section similar to FIG. 4 of a third embodiment of treatment jet.

Although the main part 13 of the passage 12 is shown in FIGS. 1 and 4 as being circular in cross section, other shapes such as oval, square, rectangular or triangular may be used if desired, as exemplified in jet 22 in FIG. 5. Similarly, although the controlling part 14 is shown in FIGS. 1 and 4 as having substantially parallel sides, they may be non-parallel as shown in jet 22 in FIG. 5. However for any chosen cross sectional shape of the main part 13, the width d of the yarn controlling part 14 is less than the width D of the main part 13, for example less than 80% and preferably less than 50% of the width D. The width w of the fluid inlet 18 is greater than the width d of the yarn controlling part 14, and may be equal to the width D of the main part 13, i.e. $D \geqq w > d$. In the case of the controlling part 14 having non-parallel sides as shown in FIG. 5, the width w is the widest dimension of the controlling part 14 and satisfies the relationship $D \geqq w > d$.

Figure 3:
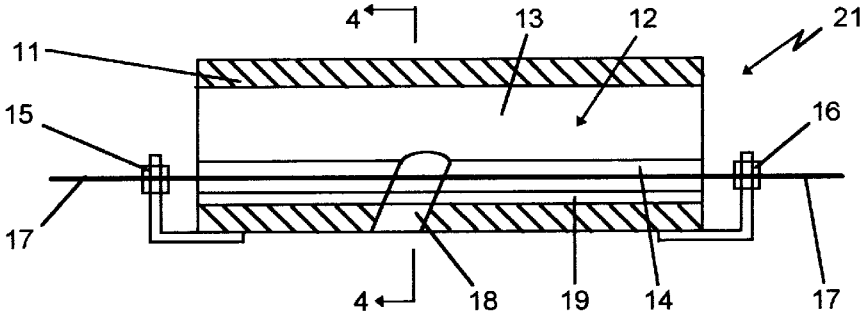
FIG. 3 is a longitudinal section of a second embodiment of treatment jet.

Referring now to FIG. 3 in conjunction with FIGS. 1 and 4, there is shown a yarn treatment jet 21 which is identical with the treatment jet 10 except in one respect. Corresponding parts of jets 10 and 21 are identified by the same numerals. Jet 21 differs from jet 10 only in that in the case of the jet 21 the fluid inlet 18 is inclined at an angle A in the direction of movement of the running yarn 17 so as to assist in forwarding the yarn 17 through the jet 21.

With the arrangement herein described, the running multifilament yarn 17 is guided through the treatment jet 10, 21 within the yarn controlling part 14 of the yarn passage 12. This provides a certain amount of constraint on the movement of the filaments of the yarn 17, thereby leading to a more uniform and consistent intermingling of the filaments along the length of the yarn 17 and from jet to jet. Furthermore, with a fluid inlet 18 having a greater width W than the width d of the yarn controlling part 14, it is ensured that the yarn 17 is subjected to the more streamlined and full rate of flow of the fluid and not, as occurs with known jets, the turbulent and random flow at the edges of the fluid jet and adjacent the sidewalls of the main part 13 of the yarn passage 12. This also ensures that the degree of intermingling is more uniform along the length of the yarn 17 and more consistent from jet to jet.

Figure 6:
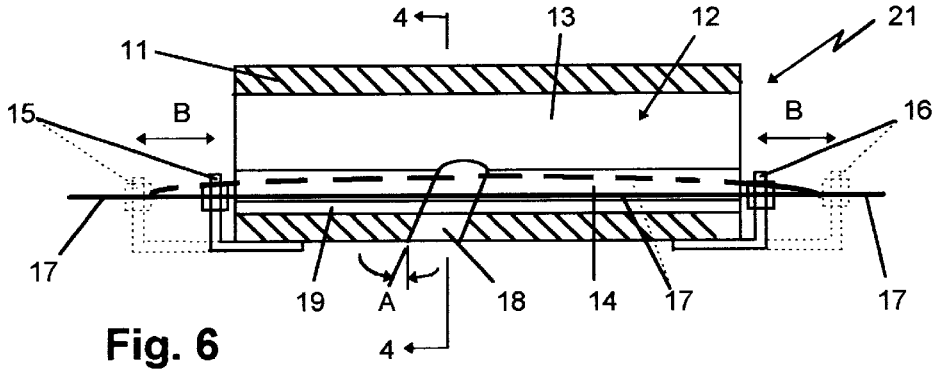
FIG. 6 is a longitudinal section of the jet of FIG. 3 showing movable yarn guides.

In operation, the force of the air jet on the yarn 17 within the controlling part 14 tends to push the yarn 17 upwardly towards the main part 13. The yarn 17 then tends to collapse back down until forced upwardly again. The rate of collapse, i.e. the rate of up and down oscillation of the yarn 17, governs the intensity and frequency of the nodes in the intermingled yarn 17. As shown in FIG. 6, the yarn inlet and outlet guides 15, 16 may be adjusted from the positions shown in full lines adjacent the jet body 11 to the positions shown in broken lines more remote from the jet body 11, the yarn 17 oscillating between the full and broken lines shown. Such movement of the guides 15, 16 alters restoring force and the degree of control exercised by the yarn guides 15, 16 on the yarn 17 as it travels through the yarn passage 12, thereby influencing the node frequency and intensity. The guides 15, 16 may be positioned as required in any particular case to provide optimum performance of the intermingling jet 10, 21.

What is claimed is:

1. A yarn treatment jet comprising an elongate body having a yarn passage extending in a longitudinal direction therethrough and an inlet for a jet of fluid which intersects the yarn passage transversely thereof, wherein the yarn passage has in cross section transverse to the longitudinal direction a main part having a main part width and a yarn controlling part having a controlling part width which is less than the main part width, and wherein the fluid inlet has a width which is greater than the width of the yarn controlling part.

2. A yarn treatment jet according to claim 1, wherein the fluid inlet intersects the yarn controlling part and directs the fluid in the direction of the main part.

3. A yarn treatment jet according to claim 2, wherein the fluid jet intersects the yarn passage perpendicularly to the longitudinal direction thereof.

4. A yarn treatment jet according to claim 2 having a yarn running therethrough, wherein the fluid jet is inclined to the yarn passage in the direction of movement of the running yarn so as to assist in forwarding the yarn through the jet.

5. A yarn treatment jet according to claim 1, wherein the fluid inlet has a width which is less than the width of the main part.

6. A yarn treatment jet according to claim 5, wherein the fluid inlet has a width which is less than 80% of the width of the main part.

7. A yarn treatment jet according to claim 6, wherein the fluid inlet has a width which is less than 50% of the width of the main part.

8. A yarn treatment jet according to claim 1, wherein the yarn passage has inlet and outlet ends and the yarn treatment jet has yarn guides adjacent the inlet and outlet ends of the yarn passage.

9. A yarn treatment jet according to claim 8, wherein the yarn guides are disposed to guide a running yarn through the yarn controlling part of the yarn passage.

10. A yarn treatment jet according to claim 9, wherein the yarn guides are positionally adjustable towards and away from the jet body.

11. A yarn treatment jet according to claim 1, wherein the body has an outside and a threading slot extending longitudinally of the body, which threading slot communicates with the outside of the body and the yarn passage.

12. A yarn treatment jet according to claim 11, wherein the threading slot communicates with the yarn passage in the yarn controlling part.

13. A yarn treatment jet according to claim 11, wherein the threading slot is curved between the outside of the body and the yarn passage.

14. A yarn treatment jet according to claim 11, wherein the threading slot has an outer end and a remainder and the outer end of the threading slot is enlarged relative to the remainder thereof.

15. A yarn treatment jet according to claim 1, wherein the main part of the yarn passage is circular in cross-section.

16. A yarn treatment jet according to claim 1, wherein the main part of the yarn passage is triangular in cross-section.

17. A yarn treatment jet according to claim 1, wherein the controlling part of the yarn passage has sides that are substantially parallel with each other.

* * * * *